US011137139B2

(12) United States Patent
Gerendas

(10) Patent No.: US 11,137,139 B2
(45) Date of Patent: Oct. 5, 2021

(54) COMBUSTION CHAMBER ASSEMBLY WITH A FLOW GUIDING DEVICE COMPRISING A WALL ELEMENT

(71) Applicant: ROLLS-ROYCE DEUTSCHLAND LTD & CO KG, Blankenfelde-Mahlow (DE)

(72) Inventor: Miklos Gerendas, Am Mellensee (DE)

(73) Assignee: ROLLS-ROYCE DEUTSCHLAND LTD & CO KG, Blankenfel de-Mahlow (DE)

( * ) Notice: Subject to any disclaimer, the term of this patent is extended or adjusted under 35 U.S.C. 154(b) by 171 days.

(21) Appl. No.: 16/510,346

(22) Filed: Jul. 12, 2019

(65) Prior Publication Data

US 2020/0033003 A1 Jan. 30, 2020

(30) Foreign Application Priority Data

Jul. 25, 2018 (DE) ..... 10 2018 212 394.2

(51) Int. Cl.
*F23R 3/00* (2006.01)
*F23R 3/26* (2006.01)
(Continued)

(52) U.S. Cl.
CPC ..... *F23R 3/002* (2013.01); *F23M 5/085* (2013.01); *F23R 3/06* (2013.01); *F23R 3/26* (2013.01);
(Continued)

(58) Field of Classification Search
CPC ..... F23R 3/002; F23R 2900/03042; F23R 2900/03044; F05D 2260/201; F05D 2260/202
See application file for complete search history.

(56) References Cited

U.S. PATENT DOCUMENTS 5,253,471 A * 10/1993 Richardson ..... F23R 3/10 60/804
5,396,759 A 3/1995 Richardson
(Continued)

FOREIGN PATENT DOCUMENTS

DE 10214573 A1 10/2003
DE 112007002152 T5 7/2009
(Continued)

OTHER PUBLICATIONS

German Search Report dated Mar. 13, 2019 for counterpart German Patent Application No. 10 2018 212 394.2.

*Primary Examiner* — Gerald L Sung
(74) *Attorney, Agent, or Firm* — Shuttleworth & Ingersoll, PLC; Timothy J. Klima

(57) ABSTRACT

A combustion chamber assembly for an engine includes a wall element fixed to a combustion chamber structure and a chamber between the wall element and the structure, the chamber being supplied with air through impingement-cooling openings in the structure and connected to the combustion space by film-cooling openings in the wall element. Two cooling-air holes formed in the structure generate a cooling-air flow toward the combustion space and past the wall element. The wall element has a flow guide device for generating at least one scavenging-air flow directed between the two cooling-air holes. A sum of flow cross sections of film-cooling openings in the wall element and of the flow guide device yields a larger area than a sum of flow cross sections of all wall element impingement-cooling openings via which air is guided through the structure into the chamber and to the rear side of the wall element.

20 Claims, 9 Drawing Sheets

(51) Int. Cl.
*F23R 3/06* (2006.01)
*F23M 5/08* (2006.01)

(52) U.S. Cl.
CPC ..... *F23R 2900/03042* (2013.01); *F23R 2900/03044* (2013.01)

(56) References Cited

U.S. PATENT DOCUMENTS

| | | | | |
|---|---|---|---|---|
| 5,490,389 | A | 2/1996 | Harrison et al. | |
| 6,470,685 | B2 | 10/2002 | Pidcock et al. | |
| 7,770,397 | B2 | 8/2010 | Patel et al. | |
| 2003/0182943 | A1 | 10/2003 | Gerendas et al. | |
| 2005/0081527 | A1* | 4/2005 | Howell | F23L 15/04 60/748 |
| 2006/0005543 | A1 | 1/2006 | Burd | |
| 2007/0245742 | A1* | 10/2007 | Dahlke | F23R 3/005 60/754 |
| 2008/0066468 | A1 | 3/2008 | Faulder et al. | |
| 2008/0115506 | A1 | 5/2008 | Patel et al. | |
| 2009/0077974 | A1 | 3/2009 | Dahlke et al. | |
| 2011/0005233 | A1* | 1/2011 | Sadig | F23M 20/005 60/754 |
| 2011/0011093 | A1 | 1/2011 | Gerendas et al. | |
| 2011/0197590 | A1 | 8/2011 | Bottcher et al. | |
| 2013/0042627 | A1* | 2/2013 | Gerendas | F23R 3/10 60/782 |
| 2016/0054001 | A1* | 2/2016 | Bangerter | F23R 3/045 60/772 |
| 2016/0273772 | A1* | 9/2016 | Cunha | F23R 3/005 |
| 2017/0241643 | A1* | 8/2017 | Mulcaire | F23R 3/50 |
| 2017/0356653 | A1 | 12/2017 | Bagchi et al. | |
| 2018/0149361 | A1* | 5/2018 | Burd | F23R 3/06 |
| 2018/0238545 | A1* | 8/2018 | Quach | F23R 3/50 |
| 2018/0306113 | A1* | 10/2018 | Morton | F23R 3/50 |
| 2018/0335211 | A1* | 11/2018 | Quach | F23R 3/06 |
| 2019/0242580 | A1* | 8/2019 | Porter | F23R 3/002 |

FOREIGN PATENT DOCUMENTS

| | | | |
|---|---|---|---|
| DE | 102009033592 | A1 | 1/2011 |
| EP | 1507116 | A1 | 2/2005 |
| FR | 2943404 | B1 | 8/2015 |

* cited by examiner

COMBUSTION CHAMBER ASSEMBLY WITH A FLOW GUIDING DEVICE COMPRISING A WALL ELEMENT

This application claims priority to German Patent Application DE102018212394.2 filed Jul. 25, 2018, the entirety of which is incorporated by reference herein.

The proposed solution relates to a combustion chamber assembly for an engine.

In the case of a combustion chamber assembly for an engine, in particular a gas turbine engine, it is commonly the case that at least one wall element is provided which has an outer side facing toward a combustion space and has a rear side averted from the combustion space. The wall element is fixed to a combustion chamber component of the combustion chamber assembly, and, here, faces with its rear side toward the combustion chamber component. The wall element is for example a combustion chamber shingle or a heat shield by means of which the combustion chamber component is protected against the high temperatures of the combustion space during operation. Since the temperatures prevailing within the combustion space during the operation of the engine generally also lie above the melting temperature of the material of a wall element, corresponding cooling is provided, for example by means of cooling rings and/or effusion cooling holes in the wall elements, which define a cooling-air inlet into the combustion chamber volume for cooling air which flows in from the outside through the combustion chamber wall. Sufficient cooling is then generally achieved downstream of the respective cooling-air inlet.

Upstream of a wall element, a cooling film is commonly generated by means of cooling-air holes provided in a combustion chamber structure, wherein the air from the individual jets of the cooling-air holes in the combustion chamber structure has merged only after a certain running distance to form a cooling film which, upstream of a cooling-air outlet in the wall element itself, protects for example a portion of a combustion chamber wall or of the wall element. Such a cooling film is, for example, in a front portion of a combustion chamber, applied along a combustion chamber wall, parallel thereto. The cooling film, which has a cooling action, is in this case generated by means of air flows, directed in the direction of the combustion space, at an edge of the at least one wall element, for example by virtue of air flows being conducted across the edge of the wall element or along the edge. The cooling-air holes in the combustion chamber structure are situated adjacent to one another along a circumferential direction and are for example provided on a combustion chamber component of the combustion chamber assembly, such as for example a base plate or a combustion chamber wall. By means of the multiple mutually adjacently situated cooling-air holes in the combustion chamber structure, air flows, which are directed in the direction of the combustion space, for a cooling film with cooling action are generated by means of inflowing air. A combustion chamber assembly having such cooling-air holes in a combustion chamber structure in the direct vicinity of wall elements fitted on the hot-gas side emerges for example from DE 102 14 573 A1 or DE 10 2009 033 592 A1.

Both for the guidance of the air flows out of the cooling-air holes in the combustion chamber structure and with regard to the thermal expansion of a wall element of the combustion chamber assembly, an edge of a wall element is commonly arranged spaced apart from a combustion chamber wall and/or from an adjacent wall element. Arranged in this gap are the cooling-air holes, which generate individual cooling-air jets which, with increasing running distance, merge to form a cooling film. These holes for generating a cooling film are commonly arranged adjacent to one another in a circumferential direction and are situated between the wall elements in the head of the combustion chamber (also referred to as heat shield) and the wall elements on the combustion chamber wall (also referred to as shingles), but also between wall elements (shingles) arranged one behind the other on the combustion chamber wall. Here, the individual air jets from the cooling-air holes do not merge to realize adequate scavenging in the region of the holes themselves, because, for strength reasons, a large web width is necessary between the cooling-air holes in the combustion chamber structure, and the air jets thus have a large spacing to one another, and the film forms only after a certain running distance as a result of merging of the individual cooling-air jets. In the immediate vicinity of the holes in the combustion chamber structure for forming the film, said film thus still has interstices.

It has already been proposed in U.S. Pat. No. 6,470,685 B2 to provide, on mutually facing edges of adjacent similar wall elements in the form of combustion chamber shingles, without interposed cooling-air openings in the combustion chamber structure, alternating openings in the wall elements with a uniform spacing to the combustion chamber structure. These openings however serve merely to prevent a standing air wall in a gap formed between the edges, which gap adversely affects a cooling film applied to the combustion chamber shingle, and to generate an air flow with a flow component in an axial direction, that is to say along a direction pointing from a compressor to a turbine of the engine through the combustion space. A relationship of said openings in the wall elements to cooling-air openings in the combustion chamber structure is not provided.

FR 2,943,404 B1 describes an arrangement in which air is introduced from two different directions, firstly through holes in the base plate and secondly through the combustion chamber wall, into a gap which extends in a circumferential direction and which is formed by the combustion chamber wall and an encircling rib which is formed as a single piece with the base plate. Owing to the above-discussed component web on the base plate, there is no interaction between said gap flow and the outflow of the cooling air of the heat shield. The pressure drop across the bores in the base plate (and thus the jet speed) is substantially uniform across the burner. The pressure drop (and thus the jet speed) across the second group of bores is substantially equal to that across the mixing air holes. Both pressure levels are therefore not determined by considerations relating to the cooling, and the pressure drop across the bores of the second group lies in the range from ⅔ to ¾ of the pressure drop across the base plate.

U.S. Pat. No. 7,770,397 B2 in turn proposes an arrangement in which a gap is formed between a lip of the heat shield and the combustion chamber wall, wherein two air flows are introduced through bore rows in slightly different directions into said gap, such that said air flows intersect in the region of the lip. Here, the pressure drop across both bore rows is similar and is determined primarily by the contour of the combustion chamber and the external aerodynamics.

There thus remains a demand for an improved combustion chamber assembly for an engine having a wall element, in the case of which, with cooling-air holes present in a combustion chamber structure for the purposes of generating a cooling film, combustion products originating from the combustion space can be more effectively prevented from arriving at the supporting structure of the combustion chamber assembly to which the wall element is fixed, because the individual jets from the cooling-air holes in the combustion chamber structure have initially not yet formed a closed film; this occurs only with increasing running distance.

Proceeding from this, the proposed solution proposes a combustion chamber assembly for an engine, having

- at least one wall element which has an outer side facing toward a combustion space and has a rear side averted from the combustion space,
- a combustion chamber structure to which the at least one wall element is fixed and toward which the rear side of the at least one wall element faces, and
- a (flow) chamber between the wall element and a portion of the combustion chamber structure, which chamber is supplied with air through impingement-cooling openings in the combustion chamber structure and is connected to the combustion space by film-cooling openings in the wall element.

At least two cooling-air holes are formed in the combustion chamber structure, which cooling-air holes are provided for generating a cooling-air flow in the direction of the combustion space and past the wall element. Furthermore, the at least one wall element has at least one flow guide device for generating at least one scavenging-air flow directed between two of the cooling-air holes in the combustion chamber structure, wherein the sum of the flow cross sections of the film-cooling holes and of the flow guide device on the wall element yields a larger area than the sum of the flow cross sections of all impingement-cooling openings for the wall element, via which impingement-cooling openings air is guided through the combustion chamber structure into the chamber and to the rear side of the at least one wall element.

The at least one wall element may thus have at least one flow guide device in order to generate at least one scavenging-air flow which is directed between two cooling-air jets from the cooling-air holes in the combustion chamber structure. Said scavenging-air flow, which is composed of at least one scavenging-air jet, then flows along the combustion chamber structure, and thus for example along a combustion chamber component of the combustion chamber structure, such as a front-side base plate or a combustion chamber wall of the combustion chamber, specifically between the cooling-air holes and thus possibly perpendicularly with respect to a cooling-air flow from the cooling-air holes. Here, owing to the proposed configuration, the scavenging-air flow is supplied or driven by a much lower pressure level than the cooling-air holes in the combustion chamber wall. The scavenging-air flow is thus significantly slower and thus ensures adequate scavenging of combustion products from said region in an extremely effective manner.

A pressure difference across the flow guide device lies for example between 10% and 50% of the pressure difference of the cooling-air openings and may, as proposed, be set for optimum action by means of the ratio of the effective area of the impingement-cooling and film-cooling openings in the combustion chamber structure and in particular in that portion of the combustion chamber structure which is assigned to the wall element which has the flow guide device and on which the wall element is mounted.

By means of the at least one flow guide device on the wall element, it is thus for example the case that at least one scavenging-air flow is generated which is directed between two cooling-air jets from cooling-air holes in the combustion chamber structure. In this way, it is possible, in particular in an intermediate space between two air jets which later merge to form a film, to realize targeted scavenging which counteracts an accumulation of combustion products. The pressure level in the chamber between the combustion chamber structure and the wall element (that is to say for example between base plate and a heat shield as wall element or between a combustion chamber wall and a combustion chamber shingle as wall element) can in this case be set through the selection of suitable areas of the impingement-cooling and film-cooling openings of the heat shield such that an optimum cooling of the wall element and an optimum scavenging of component webs present between the cooling-air holes is realized. It is thus possible, by means of the generated blow-off flow, to scavenge specifically regions situated between two cooling-air holes in the combustion chamber structure, at which any combustion products are not entrained and consequently not removed by the air flows for the cooling film with cooling action. Here, owing to the orientation of the blow-off flow by means of the flow guide device between two adjacent cooling-air holes in the combustion chamber structure, an interaction between the scavenging air of the blow-off flow and the air flows for the generation of the cooling film is prevented, and a component region outside the cooling-air holes in the combustion chamber structure is scavenged in each case.

In one design variant, the sum of the flow cross sections of the film-cooling holes and of the flow guide device in the wall element yields an area which is at least 1.2 times greater than the sum of the flow cross sections of all impingement-cooling holes for the wall element. Good scavenging results can be achieved already with such cross-sectional area ratios and the thus achievable pressure ratios between cooling-air flow and scavenging-air flow. For example, the sum of the flow cross sections of the film-cooling holes and of the flow guide device on the wall element yields an area which is 1.2 to 4 times, in particular 1.8 to 3 times, greater than the sum of the flow cross sections of all impingement-cooling holes for the wall element.

In one design variant, the flow guide device comprises at least one blow-off opening in a web which projects on the rear side of the at least one wall element and which borders the (flow) chamber. Said web then projects for example in the direction of the combustion chamber component to which the at least one wall element is fixed. In the case of a wall element formed as a heat shield (with a passage for the burner), the web thus projects for example on a rear side in the direction of a head or base plate of the combustion chamber. In the case of a wall element formed as a shingle, the web thus projects for example on the rear side radially outward or inward in the direction of the combustion chamber structure.

The at least one blow-off opening may define a flow passage which points in the direction of an intermediate space formed between two cooling-air holes, which are adjacent in a circumferential direction, in the combustion chamber structure. A scavenging-air flow emerging from the flow passage of the blow-off opening is thus directed in targeted fashion between two cooling-air jets from the cooling-air holes in the combustion chamber structure.

The at least one flow guide device may also have multiple blow-off openings which define in each case one flow passage which points in the direction of an intermediate space formed between two cooling-air holes, which are adjacent in a circumferential direction, in the combustion chamber structure. The at least two flow passages of the different blow-off openings may in this case be oriented differently. The flow passages of two blow-off openings are thus for example formed so as to run not parallel but at an angle with respect to one another. This includes for example a situation in which, at different edges of a wall element, blow-off openings of a flow guide device are provided which, owing to differently oriented flow passages, generate a blow-off flow in each case in the direction of the same row of mutually adjacently situated cooling-air holes in the combustion chamber structure, but possibly point between two different cooling-air holes in the combustion chamber structure. For example, a first blow-off opening may define a flow passage which extends radially, and thus substantially perpendicularly with respect to the circumferential direction, in a first, radially inner or radially outer edge of the wall element, whereas a second blow-off opening at a second adjoining, lateral edge as a termination in a circumferential direction with respect to the similar adjacent wall element defines a radially inwardly or radially outwardly pointing flow passage which extends in an inclined manner relative to the circumferential direction.

The flow guide device may for example be a groove or depression in the bearing surface of the web of the wall element on the combustion chamber structure, and the flow passage is thus formed partially by the wall element and partially by the combustion chamber structure, or an opening in the web of the wall element, which opening then, enclosed entirely by the wall element, defines the flow area and thus the air throughput solely on the basis of its cross section of circular or other shape.

If two air flows are directed toward the same intermediate space between two cooling-air holes in the combustion chamber structure from two adjacent wall elements (shingle-shingle, heat shield-shingle, heat shield-heat shield) through at least one correspondingly oriented blow-off opening on each of the two wall elements, then the two flows are generated with different spacings to the combustion chamber structure, such that they do not disrupt (intersect or penetrate through, displace) one another.

A first, radially extending edge of a first wall element may then in this case for example face a second, radially extending edge of a similar second wall element which is adjacent in a circumferential direction, wherein, on each of the mutually facing first and second edges, there is provided at least one blow-off opening which is oriented in each case substantially in a circumferential direction. The blow-off openings of the mutually facing first and second edges may then be arranged such that scavenging-air flows that can be generated by means of said blow-off openings do not intersect. Scavenging-air jets flowing out of the flow passages defined by the blow-off openings can thus be generated such that they do not collide with one another, for example by virtue of said scavenging-air jets being generated adjacent to one another and/or one above the other in different flow planes which are offset with respect to one another transversely to the respective flow direction.

For example, in one design variant, an encircling web extends along at least two edges of the wall element, and the flow guide device comprises in each case at least one blow-off opening, formed in the encircling web, in the region of the two edges. Alternatively, it is also possible for multiple webs to be provided which extend in each case only along one edge, such that then, blow-off openings of the flow guide device, at which at least two edges are present, are formed on different webs.

In one design variant, the wall element has four sides with in each case one edge, which define the outer contour of the wall element. The wall element may thus, in a rear view directed toward the rear side of the wall element, have a rectangular, in particular trapezoidal contour. In a refinement based on this, at least two flow guide devices may be provided at two transition regions at which two sides converge by way of their edges. For example, two flow guide devices are provided at at least two transition regions, formed as corners, of a polygonal wall element. This includes in particular a variant in which multiple flow guide devices are provided at all corners of a wall element which is polygonal in a rear view directed toward the rear side of the wall element, in order to generate a corresponding blow-off flow at all corners. Here, it is then for example the case that mutually averted edges of the wall element are assigned in each case to one row of cooling-air holes, which follow one another in a circumferential direction, in the combustion chamber structure, which cooling-air holes are situated adjacent to one another for example along two different pitch circles, that is to say pitch circles of different diameter.

In one design variant, at least one flow guide device is provided for generating at least one blow-off flow which is directed both between two cooling-air holes in the combustion chamber structure and in the direction of a wall element which is adjacent in a circumferential direction. As discussed above, it is thus possible by means of the flow guide device to generate in particular a blow-off flow which flows past or along at least one portion of an adjacent wall element before flowing onward in the direction of an intermediate space formed between two cooling-air holes in the combustion chamber structure.

At least one flow guide device may be provided for generating a blow-off flow which is directed in the direction of a corner of a wall element which is adjacent in a circumferential direction. Alternatively or in addition, two wall elements which are adjacent in a circumferential direction may be separated from one another by a gap, and a blow-off flow which flows into said gap can be generated by means of at least one flow guide device. At least a partial flow of the blow-off flow flowing into the gap may in this case then likewise be directed between two cooling-air holes in the combustion chamber structure and flow onward in this direction.

In one design variant of a proposed combustion chamber assembly, a first edge of a first wall element may face a second edge of a second wall element, which is adjacent in a circumferential direction, of the combustion chamber assembly. The first and second edges of the two different wall elements are then for example separated from one another by means of a gap extending longitudinally along a radial extent direction. In one design variant, provision is made whereby blow-off openings alternate along the radial extent direction at the mutually facing first and second edges. Blow-off openings are thus provided in alternating fashion on the first and second mutually facing edges of two adjacent wall elements. Thus, along the radial extent direction, it is for example the case that a first blow-off opening on the first edge of one wall element is followed by a second blow-off opening on the second edge of the other wall element, followed by a third blow-off opening on the first edge again. A blow-off opening on one edge is thus not situated directly opposite a blow-off opening on the other edge. The blow-off openings are rather offset with respect to one another along the radial extent direction, such that air flowing out of a blow-off opening for the blow-off flow that is to be generated can impinge on the facing edge of the respective other wall element. This can assist more effective scavenging of an intermediate space, for example in the form of an elongate gap, which is present between the first and second edges. Blow-off openings which alternate with one another on facing first and second edges of two adjacent wall elements may in this case define both flow passages which extend in a circumferential direction or point in a circumferential direction and flow passages which extend in inclined fashion relative to the circumferential direction and which point radially outward or radially inward.

By means of flow guide devices of two adjacent wall elements, it is also possible for scavenging-air flows in the direction of interstices between two cooling-air holes, which are situated in the gap between the adjacent wall elements, to be generated such that the scavenging-air flows generated from the flow guide devices do not intersect.

For a targeted blow-off of undesired combustion products in different regions, in one design variant, at least three different types of first, second and third blow-off openings are provided on a flow guide device of a wall element. The three different types of first, second and third blow-off openings define first, second and third types of flow passages, of which a first flow passage extends along a radial extent direction (for example then radially outward or radially inward) on the combustion chamber assembly, whereas a second flow passage extends along the circumferential direction and a third flow passage extends so as to be both inclined with respect to the radial extent direction and inclined with respect to the circumferential direction. In one design variant, a third flow passage, which is defined by a third type of blow-off opening, may for example extend parallel to an angular bisector which runs through a corner of a polygonal wall element, at which two sides of the wall element converge by way of their edges.

In particular, in this context, provision may also be made whereby the at least one flow guide device has at least three different types of first, second and third blow-off openings, which define first, second and third flow passages, wherein a first flow passage extends along a radial extent direction, a second flow passage extends substantially along a circumferential direction, and a third flow passage extends so as to be both inclined with respect to the radial extent direction and inclined with respect to the circumferential direction. The second flow passage and/or the third flow passage may thus be arranged such that a scavenging-air flow that can be generated by means thereof intersects neither a scavenging-air flow of an adjacent, similar wall element nor a cooling-air flow from the cooling-air openings.

It is basically also possible for at least two rows of cooling-air holes to be provided in the combustion chamber structure, by means of which cooling-air holes it is possible for air flows directed in the direction of the combustion space for a cooling film with cooling action to be generated at two mutually averted edges of the at least one wall element by means of air flowing in via the combustion chamber component. For example, it is known for in each case one cooling film with cooling action for an internal and an external combustion chamber wall of the combustion chamber to be generated both at a radially inner edge and at a radially outer edge of a heat shield. In particular in a design variant of said type, it is possible for one or more flow guide devices of the wall element to be provided for generating blow-off flows for the at least two rows of cooling-air holes in the combustion chamber structure. A wall element thus has, in the region of its rear side, at least two flow guide devices for the purposes of generating at least two blow-off flows which are directed between two cooling-air holes in the combustion chamber structure of two different rows of cooling-air holes in the combustion chamber structure.

As already discussed above, the at least one wall element may be formed by a heat shield or by a combustion chamber shingle. For example, in the case of a wall element formed as a heat shield, blow-off openings of the flow guide device are formed on a web which projects in the direction of the combustion chamber component to which the heat shield is fixed, such that air flowing in via the combustion chamber component can, by means of the flow guide device, be utilized at least for generating a radially outwardly and/or radially inwardly pointing blow-off flow which is directed between two cooling-air holes in the combustion chamber structure in order to achieve adequate scavenging even in component regions outside the cooling film.

In one design variant, it is for example the case that two (adjacent) wall elements are formed in each case as combustion chamber shingles and are mounted on a combustion chamber wall of the combustion chamber structure. An angle of 150 to 210 degrees is then provided between these wall elements on the side facing toward the combustion space, wherein a row of cooling-air holes for forming a cooling-air film on one of the two wall elements is situated between said two wall elements in a circumferential direction. A scavenging-air flow specifically in the direction of the interstice between two cooling-air holes can then be generated by means of at least one flow guide device on at least one of said wall elements.

Alternatively or in addition, a wall element of the combustion chamber assembly is formed as a heat shield with a through hole for a fuel nozzle and is mounted onto a base plate of the combustion chamber structure. Another wall element of the combustion chamber assembly is formed as a combustion chamber shingle and is mounted onto a combustion chamber wall of the combustion chamber structure. An angle of 70 to 120 degrees is then for example provided between said two different wall elements of the combustion chamber assembly on the side facing toward the combustion space, wherein a row of cooling-air holes is situated between said two different wall elements in a circumferential direction, said row being provided for the purposes of forming a cooling-air film on the other wall element formed as combustion chamber shingle. A scavenging-air flow in the direction of the interstice between two cooling-air holes can then be generated here by means of at least one flow guide device on one of the two wall elements.

It is basically possible for the cooling-air holes in the combustion chamber structure to be formed on a combustion chamber component, to which the wall element with the at least one flow guide device is fixed, of the combustion chamber structure. The combustion chamber component may for example be a part of the combustion chamber wall or a head or base plate of the combustion chamber.

On the basis of the proposed solution, a gas turbine engine with a combustion chamber which has a proposed combustion chamber assembly is furthermore also provided.

The appended figures illustrate exemplary possible design variants of the proposed solution.

In the figures:

FIG. 1 shows, in a detail, a longitudinal section through a combustion chamber assembly with a focus on a connecting point of a base plate of the combustion chamber assembly and a heat shield mounted spaced apart from said base plate and on a combustion chamber wall of the combustion chamber, illustrating an orientation of scavenging-air jets between air jets which emerge from the base plate and later form a cooling film;

Figure 4:
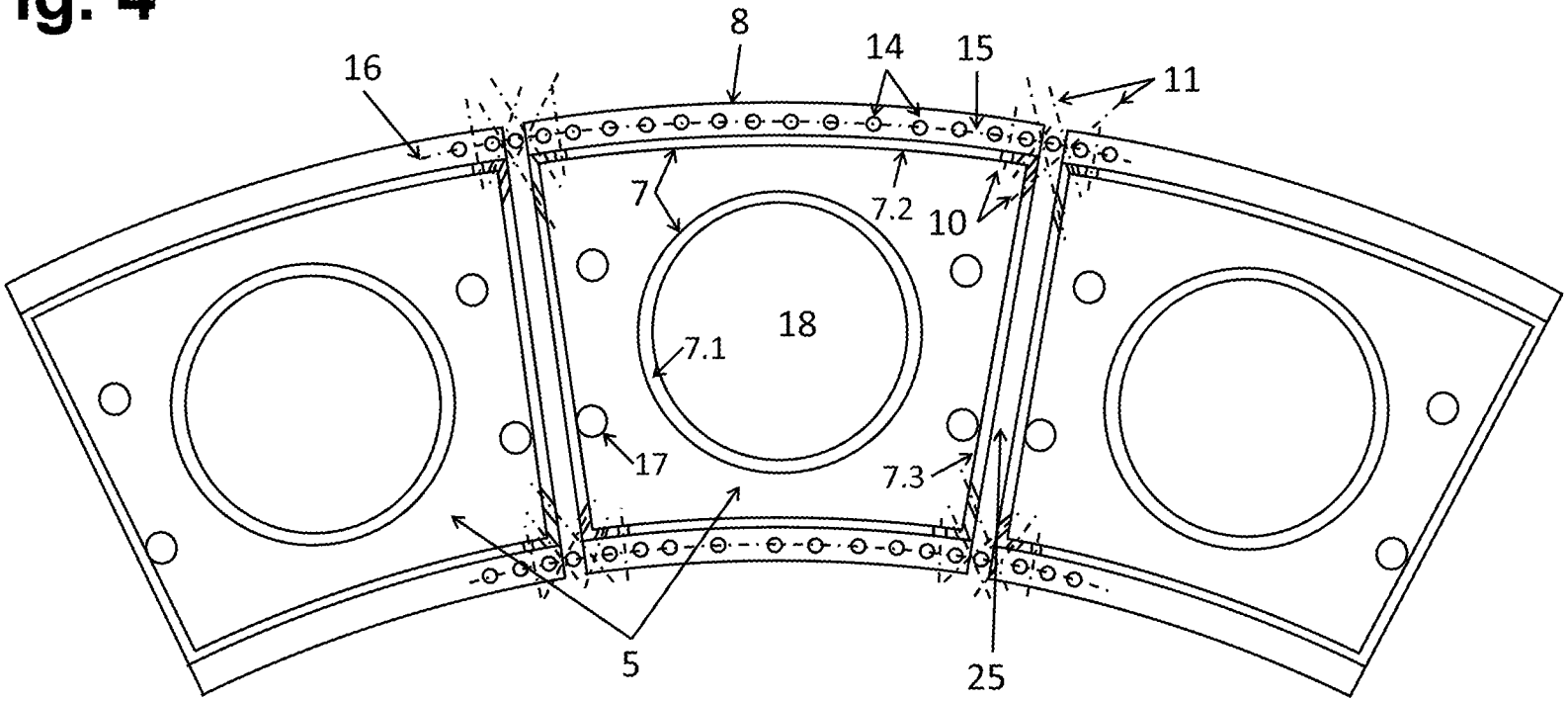
Figure 5:
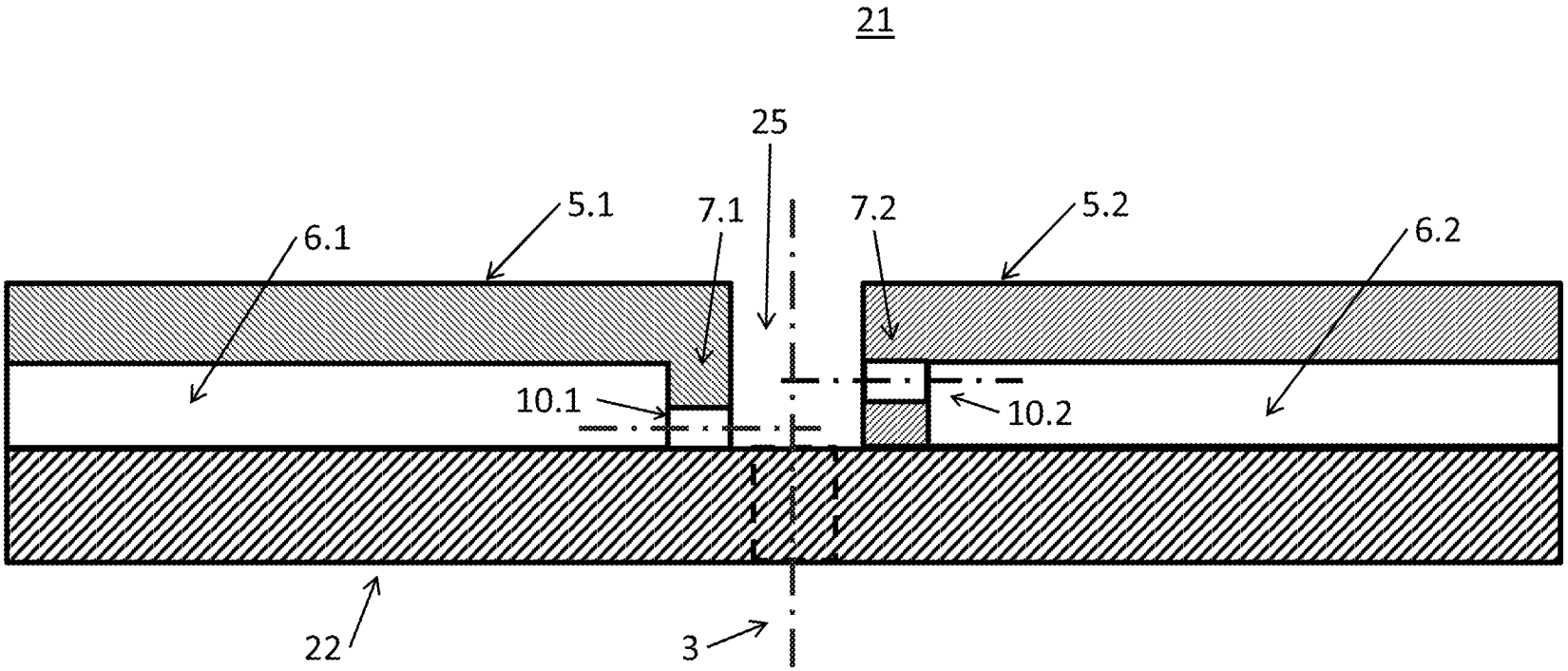
Figure 6A:
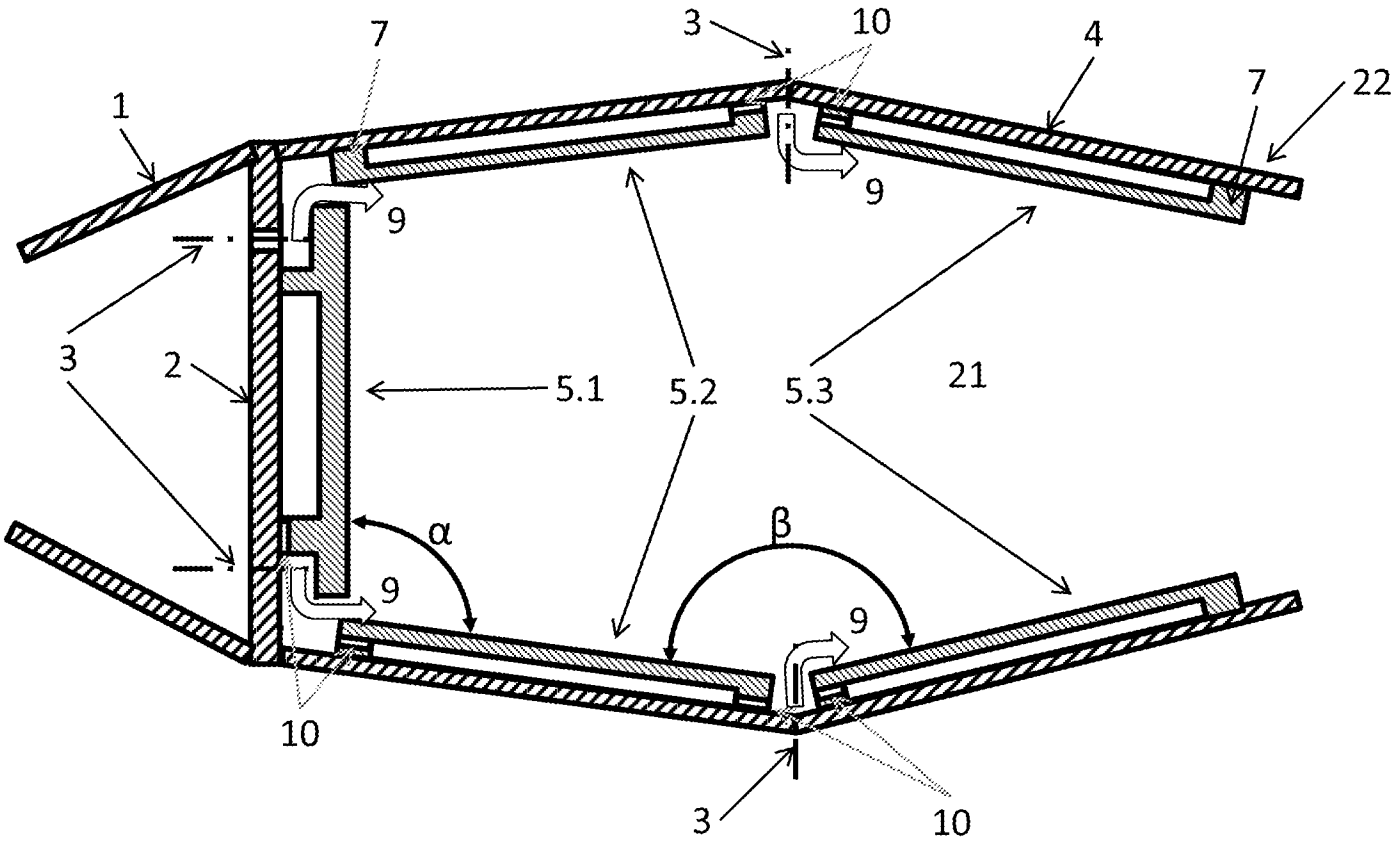
Figure 6B:
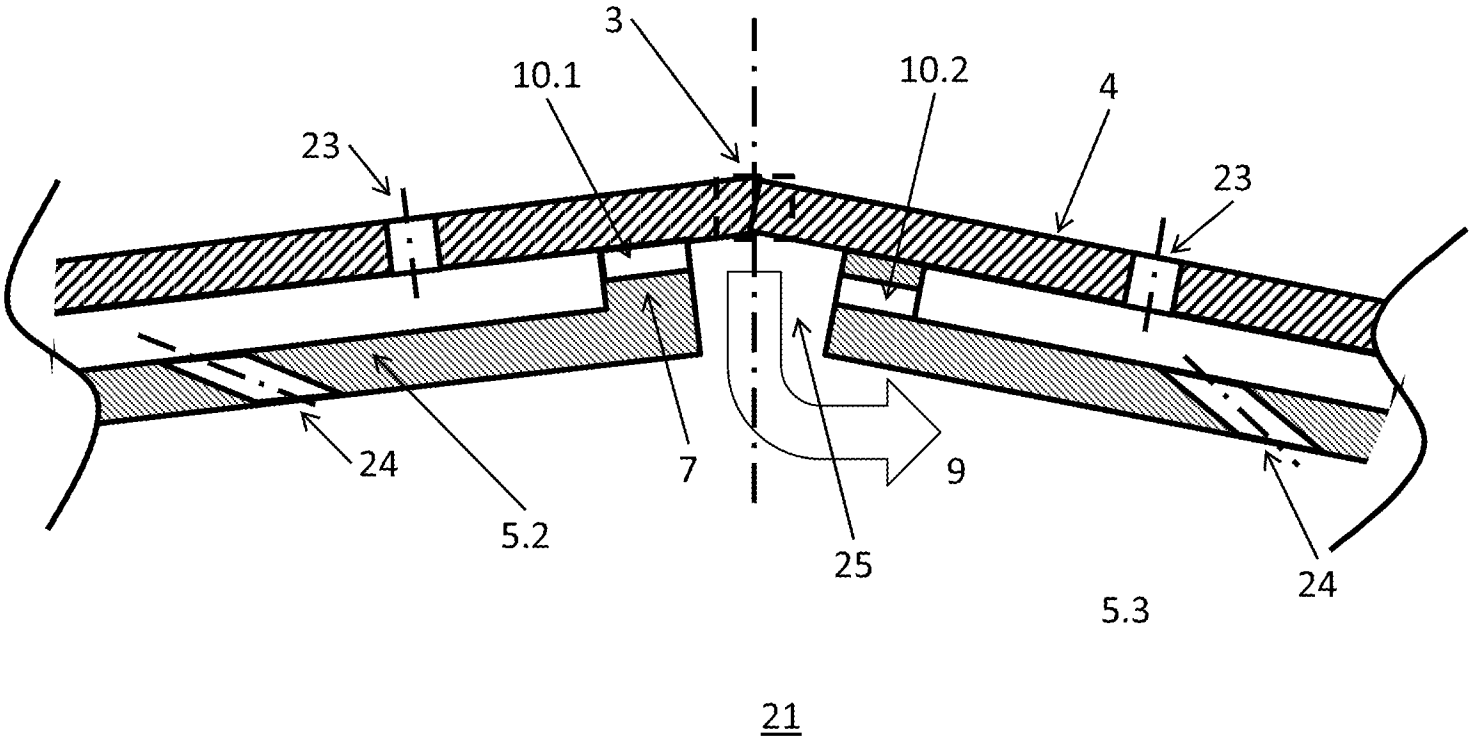
Figure 7A:
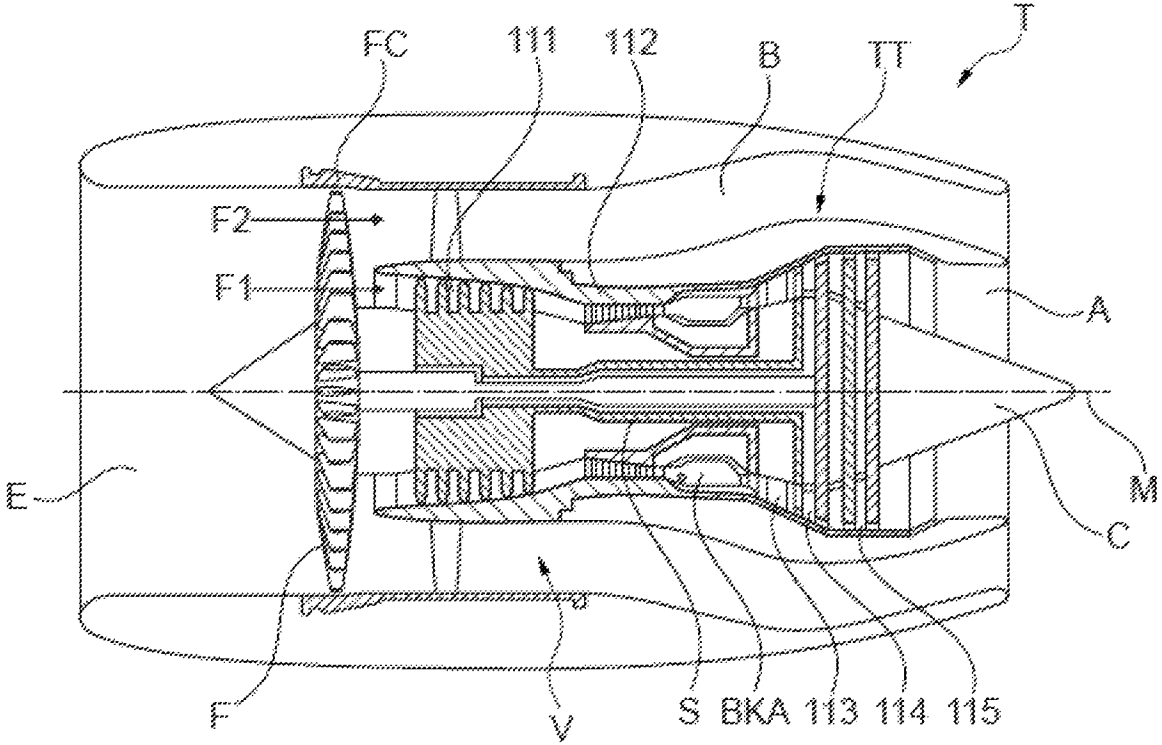
Figure 7B:
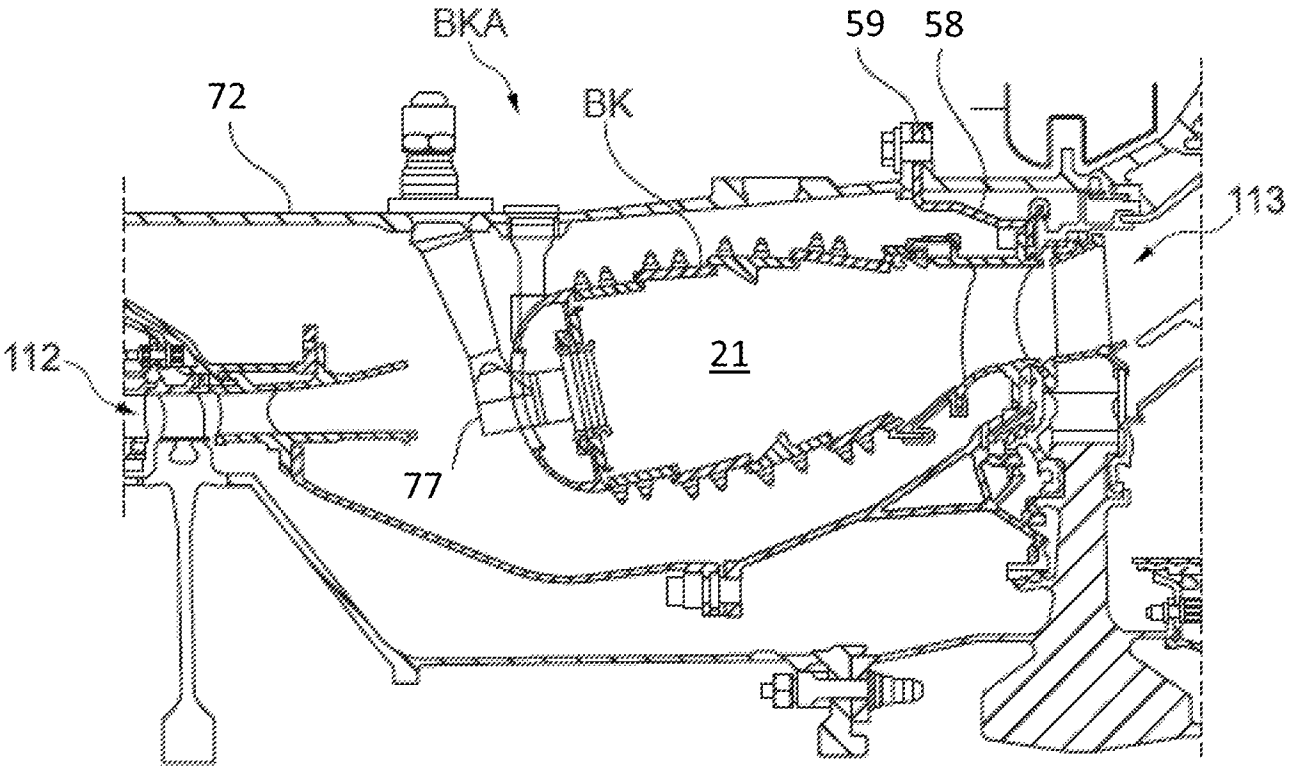

FIG. 4 shows, with a view directed onto the respective rear side, multiple heat shields, which are situated adjacent to one another along a circumferential direction, of a proposed combustion chamber assembly, wherein the flow guide devices are provided with scavenging-air openings for generating the scavenging-air jets, which are in each case directed in particular onto the component web between two film-cooling openings in the base plate of the combustion chamber assembly;

FIG. 5 shows, in a detail and with a view along the gap between two heat shields in a radial direction, an arrangement of two scavenging-air openings in adjacent heat shields, which generate scavenging-air jets with different spacings to the base plate and are directed toward the same interstice between the cooling-air openings for forming a cooling film;

FIG. 6A shows a longitudinal section through the entire combustion chamber, in this case with wall elements not only on the base plate around the burner but also on the combustion chamber wall, in order that no part of a combustion chamber structure of the combustion chamber is directly exposed to the hot gas in the combustion space of the combustion chamber;

FIG. 6B shows an enlarged detail of FIG. 6A showing details of an interstice between wall elements situated upstream and the wall elements situated downstream with interposed holes in the combustion chamber structure for the purposes of forming a cooling film on the wall element situated downstream;

FIG. 7A shows an engine in which a combustion chamber assembly corresponding to FIGS. 1 to 6B is used;

FIG. 7B shows, in a detail and on an enlarged scale, the combustion chamber of the engine of FIG. 7A.

FIG. 7A illustrates, schematically and in a sectional illustration, a (gas turbine) engine T, in which the individual engine components are arranged one behind the other along an axis of rotation or central axis M, and the engine T is formed as a turbofan engine. At an inlet or intake E of the engine T, air is drawn in along an inlet direction by means of a fan F. This fan F, which is arranged in a fan casing FC, is driven by means of a rotor shaft S, which is set in rotation by a turbine TT of the engine T. Here, the turbine TT adjoins a compressor V, which comprises for example a low-pressure compressor 111 and a high-pressure compressor 112, and possibly also a medium-pressure compressor. The fan F firstly feeds air in a primary air flow F1 to the compressor V and secondly, in order to generate the thrust, feeds air in a secondary air flow F2 to a secondary flow passage or bypass passage B. Here, the bypass passage B runs around a core engine, which comprises the compressor V and the turbine TT and comprises a primary flow passage for the air fed to the core engine by the fan F.

The air conveyed into the primary flow passage by means of the compressor V passes into a combustion chamber portion BKA of the core engine, in which the drive energy for driving the turbine TT is generated. For this purpose, the turbine TT has a high-pressure turbine 113, a medium-pressure turbine 114 and a low-pressure turbine 115. Here, the energy released during the combustion is used by the turbine TT to drive the rotor shaft S and thus the fan F in order to generate the required thrust by means of the air conveyed into the bypass passage B. Both the air from the bypass passage B and the exhaust gases from the primary flow passage of the core engine flow out via an outlet A at the end of the engine T. In this arrangement, the outlet A generally has a thrust nozzle with a centrally arranged outlet cone C.

FIG. 7B shows a longitudinal section through the combustion chamber portion BKA of the engine T. It is possible from this to see in particular an (annular) combustion chamber BK of the engine T. For the injection of fuel or of a air-fuel mixture into a combustion space 21 of the combustion chamber BK, a nozzle assembly is provided. Said nozzle assembly comprises a combustion chamber ring, on which multiple fuel nozzles 77 are arranged along a circular line around the central axis M. Here, on the combustion chamber ring, there are provided the nozzle outlet openings of the respective fuel nozzles 77 which are situated within the combustion chamber BK. Here, each fuel nozzle 77 comprises a flange by means of which a fuel nozzle 77 is screwed to an outer casing 72 of the combustion chamber portion BKA. The illustrated combustion chamber BK is in this case for example a (fully) annular combustion chamber such as is used in gas turbine engines. Via an arm 58 and a flange 59, an outer combustion chamber wall of the combustion chamber BK is connected to the outer casing 72.

Figure 1:
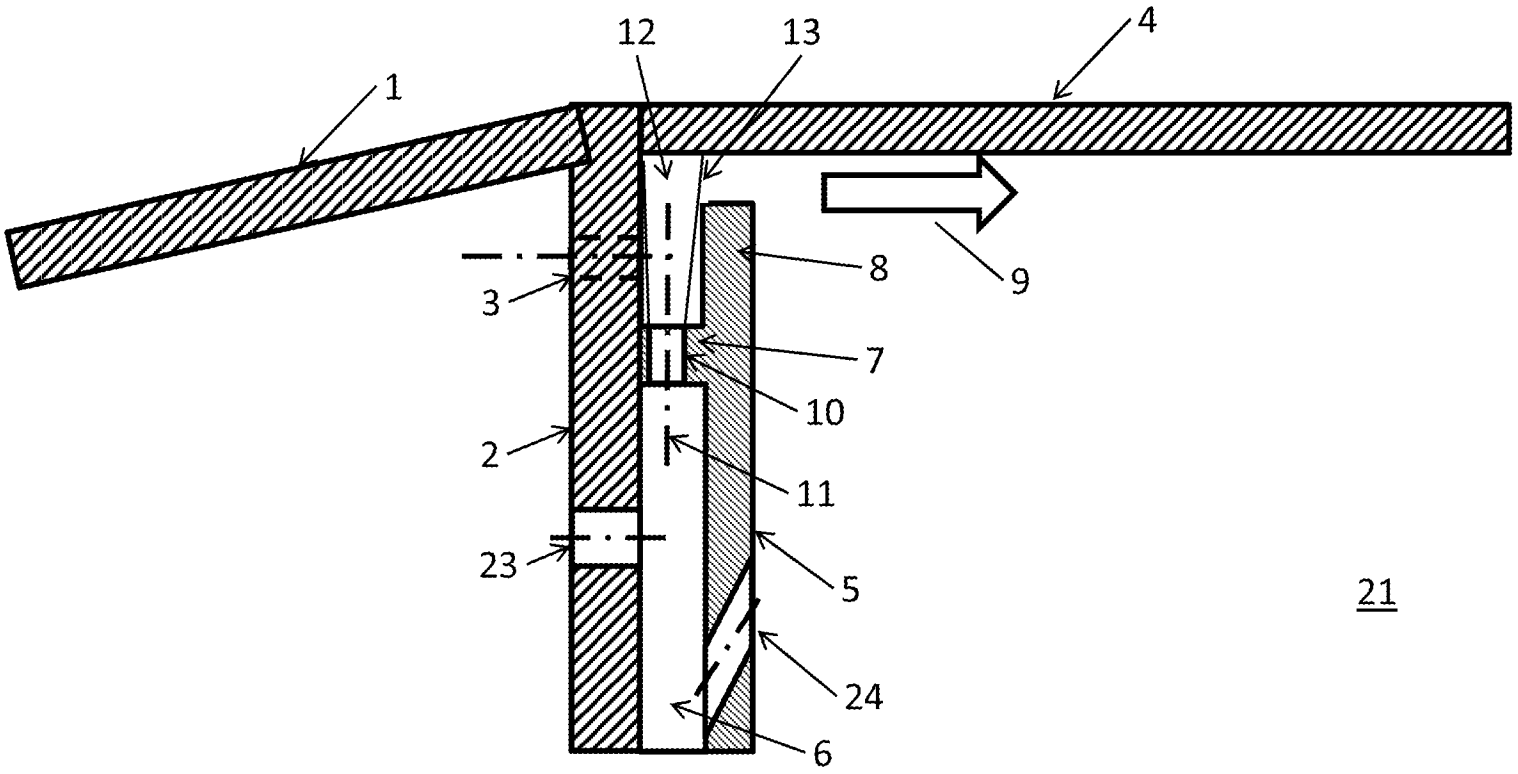

FIG. 1 shows the combustion chamber BK in longitudinal section with a design variant of a proposed combustion chamber assembly. Here, in the intended installed state, a wall element 5, in FIG. 1 in the form of a heat shield, lies with an edge-side web 7 on a front-side base plate 2 of the combustion chamber BK. The base plate 2 is connected to a cover 1 situated upstream and to a combustion chamber wall 4 situated downstream, and thus forms a combustion chamber structure 22, which encases the combustion space 21, of the combustion chamber BK.

The wall element 5 has an outer side facing toward the combustion space 21 and has a rear side which is averted from the combustion space 21 and which thus faces toward the base plate 2. A (flow) chamber 6 is formed between the wall element 5 and the base plate 2 of the combustion chamber structure 22, which (flow) chamber is supplied with air through impingement-cooling openings 23 in the combustion chamber structure 22 and is connected to the combustion space 21 by film-cooling openings 24 in the wall element 5. Also formed in the combustion chamber structure 22, in this case on the base plate 2, are cooling-air holes 3 which are provided for generating a cooling-air flow which flows in the direction of the combustion space 21 and past the wall element 5.

For the generation of at least one scavenging-air flow 12 which is directed between two of the cooling-air holes 3, a flow guide device 10 for scavenging air is provided in the wall element 5. Said flow guide device 10 has multiple blow-off openings 10.1, 10.2 and 10.3 which are formed on the web 7 projecting on the edge side and which define in each case one flow passage. Here, a radially extending blow-off opening 10.1 extends along an axis 11 and is oriented such that a scavenging-air jet 12.1 (see FIG. 2), formed in said blow-out opening, of the scavenging-air flow 12 flows over a component web 20 between two cooling-air holes 3 in the combustion chamber structure 22 (see FIG. 3). In this way, during the operation of the engine T, a region of the combustion chamber structure 22 on the combustion chamber wall 4 outside the cooling-air openings 3 is freed from hot gas, that is to say is scavenged. Here, jet edges 13, 13.1 of a generated scavenging-air jet of a scavenging-air flow 12 adjoin cooling-air jets 14 from the cooling-air openings 3, and are ideally tangent to these.

Provision is made here whereby the sum of the flow cross sections of the film-cooling holes 24 and of the flow guide device 10 (more specifically of the blow-off openings and of the flow passages 10.1, 10.2 and 10.3, defined thereby, of the flow guide device 10) in the wall element 5 yields an area which is at least 1.2 times greater than the sum of the flow cross sections of all impingement-cooling holes 23 in the region of a wall element 5. In this way, the flow guide device 10 of the wall element 5 is fed with a much lower pressure level from the chamber 6 than the cooling-air holes 3 in the base plate 2, because the greater part of the overall pressure drop across the combination of base plate 2 and wall element 5 occurs across the base plate 2, but the same overall pressure drop occurs across the cooling-air holes 3 alone.

Figure 2:
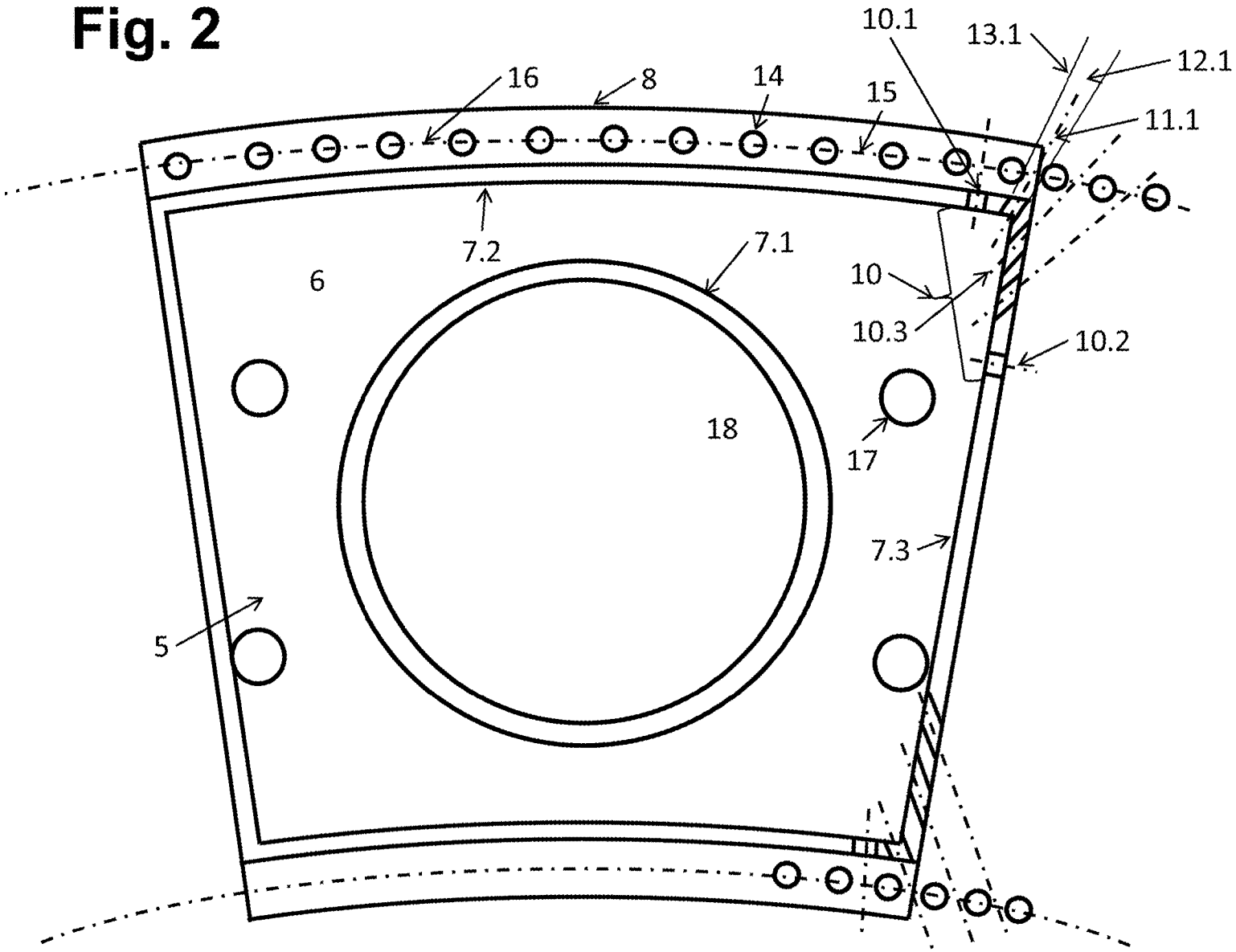
FIG. 2 shows, in a detail and with a view directed toward the rear side, the heat shield with several flow guide devices on the edge of the heat shield for the purposes of generating scavenging-air jets which are directed into interstices between those air jets which emerge from the base plate and later form the cooling film.

FIG. 2 shows, with a view directed onto a rear side, the wall element 5 with stud bolts 17 (or similar fastening elements) which are provided thereon and by means of which the wall element 5, with the edge-side encircling web 7, is mounted, so as to be spaced apart from the base plate 2, on the combustion chamber structure 22 and in particular on the base plate 2. Whilst an additional, central web 7, which projects on the rear side, of the wall element 5 forms an edge 7.1 which delimits the wall element 5 in the direction of a through bore 18 for the fuel nozzle 77, the edge-side encircling web 7 forms radially outer and radially inner edges 7.2 in the direction of the cooling-air holes 3 for generating a cooling film 9 which cools the combustion chamber wall 4 and two lateral edges 7.3 which each extend radially and which each face toward similar wall elements 5 situated adjacent in a circumferential direction.

In the installed state of the combustion chamber assembly, the edges 7.1, 7.2 and 7.3 define the (flow) chamber 6 in which a pressure prevails between the pressure at the compressor outlet and in the combustion space 21. With the flow guide device 10, the blow-off openings 10.1, 10.2 and 10.3 of which are formed for example from individual grooves or bores in the web 7, scavenging-air jets 12.1 flow out of said chamber 6 in the direction of interstices 15 between cooling-air jets 14 from the cooling-air holes 3 in order to scavenge the region outside the cooling-air holes 3. On the outer and the inner edge 7.2 of the wall element 5, that is to say in the direction of the inner and the outer combustion chamber wall 4, some of the blow-off openings 10.1, 10.2 and 10.3 of the flow guide device 10 in the central region of the edge 7.2 are arranged radially. In the vicinity of the corners of the wall element 5, blow-off openings 10.1 are inclined in the direction of the corner, in order to also scavenge the interstices 15 between the cooling-air jets 14 which are arranged between two adjacent wall elements 5.

The blow-off openings 10.1, 10.2 and 10.3 of the flow guide device 10 may locally have a different orientation with respect to the extent direction of the edge-side web 7. Thus, in the simplest case, in particular if the radially extending edge 7.2 of the wall element 5 runs as an arc substantially parallel to a pitch circle 16 along which the cooling-air holes 3 are arranged, the blow-off openings 10.1 are formed as substantially radial grooves or bores which extend perpendicularly through the edge 7.2. The blow-off openings 10.1 (of a first type) are in this case arranged spaced apart from one another in a circumferential direction of the edge 7.2 and thus in a circumferential direction of the pitch circle 16 of the cooling-air holes 3, wherein a spacing of the blow-off openings 10.1 substantially corresponds to the spacing of the cooling-air holes 3 for forming a wall film 9 in a circumferential direction.

In the region of the lateral edge 7.3 of the wall element 5, adjacent to a similar wall element which is situated adjacent in a circumferential direction, individual blow-off openings 10.2 (of a second type) of the flow guide device 10 are oriented substantially in the circumferential direction and are arranged such that the scavenging-air jets generated by adjacent wall elements 5 do not intersect. The flow passages, defined by the blow-off openings 10.2, of adjacent wall elements 5 which face one another are situated in planes which are mutually offset in an axial direction in order to prevent scavenging-air jets which are generated by means of said flow passages from intersecting.

In the region of the corners of the wall element 5, provision is furthermore made for the orientation of the individual blow-off openings 10.3 (of a third type) in the web 7 to be adapted and for an angle to be provided which differs from 90° with respect to the extent of the web 7, such that the blow-off openings 10.3 point into those interstices 15 between the cooling-air holes 3 which are situated outside the region in which the edge 7.2 lies parallel to the pitch circle 16 of the cooling-air holes 3. Provision is made here whereby the scavenging-air jets of the scavenging-air flow 12 from the flow guide device 10 of the wall element 5 flow with a much lower speed into the interstices 15 between the cooling-air jets 14 from the cooling-air holes 3 in the base plate 2 than the cooling-air jets 14 themselves. This is achieved by means of the abovementioned much smaller pressure difference across the flow guide device 10 in relation to the cooling-air holes 3.

Figure 3:
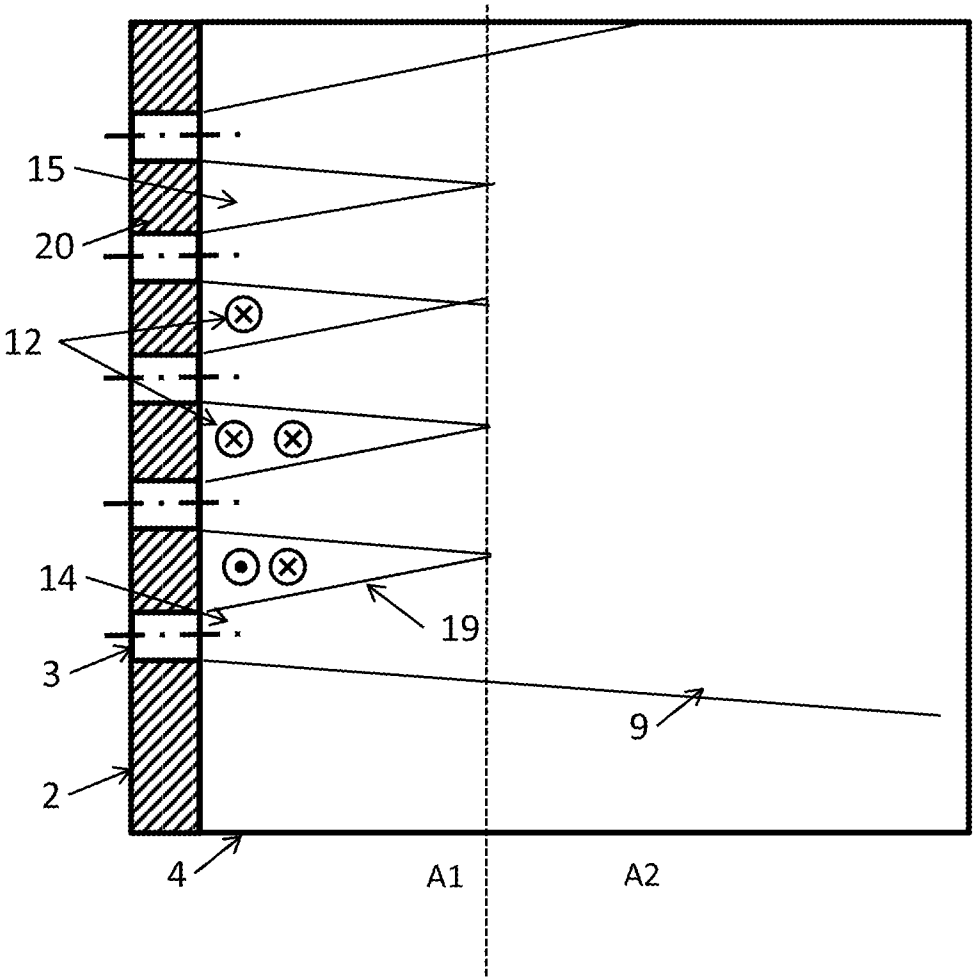
FIG. 3 shows a schematic developed view along the flow path of the air jets from the base plate of the combustion chamber assembly which later form the cooling film, illustrating scavenging-air jets which have been generated by the heat shield and which fill the interstice between the component webs between cooling-air openings in the base plate and the air jets formed from these.

FIG. 3 shows a schematic developed view along the flow path of the cooling-air jets 14 from the base plate 2 of the combustion chamber BK, which further downstream form the cooling film 9. Also illustrated here is the widening of the cooling film 9 in relation to the scavenging-air jets of the scavenging-air flow 12 from the wall element 5, which fill the interstices 15 that initially still exist between the cooling-air jets 14 over the component webs 20 between the cooling-air openings 3 in the base plate 2. Here, the individual cooling-air jets 14 are, in a first portion A1, still spaced apart from one another via edges 19 before, further downstream, they merge in a subsequent portion to form a closed cooling film 9 with cooling action. An interstice 15 between two adjacent cooling-air jets 14 can be filled by one or two scavenging-air jets 12. If two scavenging-air jets 12 flow through the same interstice 15, then they are generated with different spacings to the combustion chamber structure 22, for example the base plate 2, such that they do not disrupt one another. This figure illustrates a flow of the scavenging-air jets of the scavenging-air flow 12 through the interstice 15 in the same direction, as can also be seen from the arrangement according to FIGS. 4 and 5. A throughflow in opposite directions is alternatively possible, as can be seen from the arrangement in FIGS. 6A and 6B.

FIG. 4 shows, with a view directed onto the rear side, multiple wall elements 5 with flow guide devices 10 for scavenging air, which are oriented such that the scavenging-air jets, generated by said flow guide devices 10, of the respective scavenging-air flows 12 flow through the interstices 15 between the cooling-air jets 14 from the combustion chamber structure 22 and scavenge the region outside the cooling-air holes 3 or outside the cooling-air jets 14. On the outer and the inner edge 7.2 of the wall element 5, that is to say in the direction of the inner and the outer combustion chamber wall 4, the flow guide devices 10 in the central region of the edge 7.2 are arranged radially. In the vicinity of the corners of the wall element, the axes 11 of the flow guide devices 10 are however inclined in the direction of the corner, in order to also scavenge the interstices 15 between the cooling-air jets 14 which are arranged between two wall elements 5.

FIG. 5 shows a possibility of how, from adjacent wall elements 5.1 and 5.2, two scavenging-air jets can be generated from blow-off openings 10.1 and 10.2, which form flow passages, with different spacings to the combustion chamber structure 22. Here, both scavenging-air jets are directed toward the same interstice 15 between the cooling-air jets 14. In one wall element 5.1, a blow-off opening 10.1 of the flow guide device 10 is formed as a groove in the bearing surface of the edge 7.1 of the wall element 5.1 on the combustion chamber structure 22 (left). In the adjacent wall element 5.2, a blow-off opening 10.2 of the flow guide device 10 is formed as a bore through the edge 7.2 of the wall element 5.2. The section plane for the illustration in FIG. 5 has intentionally been laid through the interstice between the individual cooling-air holes 3 in the combustion chamber structure 22, such that the flow guide device 10 in the web 7 of the respective wall element 5.1 or 5.2 for generating a scavenging-air flow 12 lies clearly visible in the section plane of the illustration. The cooling-air holes 3 in the combustion chamber structure 22 of the combustion chamber BK for generating the cooling film 9 are however thus indicated merely as a dashed contour on the downstream wall element 5.2 in FIG. 5, because said cooling-air holes lie in a plane parallel to the section plane.

FIG. 6A shows a longitudinal section through the combustion chamber BK with different wall elements 5.1, 5.2 and 5.3. One wall element 5.1 forms a heat shield, which is arranged on the base plate 2 of the combustion chamber structure 22. Wall elements 5.2 and 5.3 are situated further downstream and are fixed as combustion chamber shingles to the combustion chamber wall 4 that encloses the combustion space 21. FIG. 6B shows an enlarged detail from FIG. 6A, illustrating details of a gap 25 that is formed between two wall elements 5.2 and 5.3.

The cooling-air openings 3 for forming the cooling film 9 with cooling action on the downstream wall elements 5.2 and 5.3 are situated both between wall elements 5.1, which are formed as a heat shield and situated adjacent to one another in a circumferential direction, on the base plate 2 and between the wall elements 5.2 and 5.3 on the combustion chamber wall 4. Analogously to the description above, corresponding flow guide devices 10 for generating scavenging-air jets of a scavenging-air flow 12 between cooling-air jets 14 may also be provided on wall elements 5.2 and 5.3 on the combustion chamber wall, in order that interstices 15 between the cooling-air jets 14 are adequately scavenged of combustion products. An angle $\alpha$ in the range from 70 to 120 degrees is enclosed between a wall element 5.1, which forms a heat shield mounted on the base plate 2, and a wall element 5.2 which adjoins the former wall element downstream and which forms a combustion chamber shingle. By contrast, an angle $\beta$ of 150 to 210 degrees is enclosed, for example on the side facing toward the combustion space 21, between two wall elements 5.2 and 5.3 which follow one another in an axial direction and which each form a combustion chamber shingle.

The scavenging-air jets of the scavenging-air flow 12 from the wall elements 5.2 and 5.3 which form combustion chamber shingles are generated by blow-off openings 10.1 and 10.2 of the flow guide devices 10 with different spacings in order that said scavenging-air jets do not impede one another as they flow through an interstice 15 between two cooling-air jets 14 in the gap 25 between the wall elements 5.2 and 5.3.

Furthermore, an arrangement is also possible in which, in a circumferential direction, only every second interstice 15 between two cooling-air jets 14 is scavenged by a scavenging-air jet from the wall element 5.2, and the interstices 15 situated in between are scavenged from the wall element 5.3 in the opposite direction. Analogously, such an arrangement may also be used between wall elements 5.1 on the base plate 2 and wall elements 5.2 on the combustion chamber wall 4 in that, in a circumferential direction, only every second interstice 15 between two cooling-air jets 14 is scavenged by a scavenging-air jet from the wall element 5.1, and the interstices 15 situated in between are scavenged from the wall element 5.2 in the opposite direction.

In the case of a combustion chamber assembly proposed in the synopsis of FIGS. 1 to 6B, each wall element 5, 5.1, 5.2, 5.3 has a flow guide device 10 for generating scavenging-air flows 12. The scavenging-air flows 12 are each directed toward the interstice 15 between in each case two cooling-air jets 14 of a row, arranged in a circumferential direction, of cooling-air holes 14 which are provided in a combustion chamber component 2 or 4 of the combustion chamber structure 22. On that part of the web 7 of a wall element 5, 5.1, 5.2, 5.3 which extends in the circumferential direction, said flow guide devices 10 are arranged purely radially or axially in the central region of an edge 7.2. In the vicinity of the corners of the wall element 5, 5.1, 5.2, 5.3, blow-off openings 10.2 as part of the flow guide devices 10 are however inclined in the direction of the corner, in order to also scavenge the interstices 15 between the cooling-air jets 14 which are arranged between two adjacent wall elements 5, 5.1, 5.2, 5.3.

LIST OF REFERENCE DESIGNATIONS

1 Cover of the base plate
2 Base plate
3 Cooling-air opening for forming the cooling film
4 Combustion chamber wall
5 Wall element
**5.*n*** n-th wall element
6 Chamber (between wall element 5 and combustion chamber **6.*m*** structure)
7 Chamber between m-th wall element **5.*m* and combustion chamber structure 22**
7.1 Web
7.2 Edge at burner bore
7.3 Edge at cooling film
8 Edge in circumferential direction
Lip
9 Cooling film
10 Flow guide device for scavenging air (entirety)
**10.*n*** n-th flow guide device, individual/blow-off opening (passage or bore)
11 Axis of the guide device
12 Scavenging-air flow (formed from scavenging-air jets)
**12.*n*** Individual scavenging-air jet
13 Jet edge
14 Cooling-air jet for forming the cooling film
15 Intermediate space/interstice between two cooling-air jets
16 Pitch circle
17 Stud bolt for the fastening of the wall element
18 Through bore for burner
19 Edge of the cooling-air jet
20 (Component) web in base plate between cooling-air openings
21 Combustion space

22 Combustion chamber structure (with cover 1, base plate 2 and combustion chamber wall 4)
23 Impingement-cooling hole
24 Film-cooling hole
25 Gap
58 Arm
59 Flange
72 Outer casing
77 Fuel nozzle
111 Low-pressure compressor
112 High-pressure compressor
113 High-pressure turbine
114 Medium-pressure turbine
115 Low-pressure turbine
E Inlet/Intake
F Fan
F1, F2 Fluid flow
FC Fan casing
L Longitudinal axis
M Central axis/axis of rotation
S Rotor shaft
T (Turbofan) engine
TT Turbine
V Compressor
α, β Angles

The invention claimed is:

1. A combustion chamber assembly for an engine, comprising:

a wall element which has an outer side facing toward a combustion space and has a rear side facing away from the combustion space, the wall element including film-cooling holes therethrough, a combustion chamber structure to which the wall element is fixed and toward which the rear side of the wall element faces, the combustion chamber structure including impingement-cooling openings therethrough, a chamber between the wall element and a portion of the combustion chamber structure, air being supplied through the impingement-cooling openings into the chamber and to the rear side of the wall element, the chamber being connected to the combustion space by the film-cooling holes in the wall element, cooling-air holes formed in the combustion chamber structure for generating a cooling-air flow in a direction of the combustion space and past the wall element, wherein the wall element includes a flow guide device having a flow cross section for generating a scavenging-air flow directed between two of the cooling-air holes in the combustion chamber structure, wherein a sum of flow cross sections of all of the film-cooling holes and of the flow guide device on the wall element has a larger area than a sum of flow cross sections of all of the impingement-cooling openings for the wall element.

2. The combustion chamber assembly according to claim 1, wherein the larger area is at least 1.2 times greater than the sum of the flow cross sections of all of the impingement-cooling holes for the wall element.

3. The combustion chamber assembly according to claim 2, wherein the larger area is 1.2 to 4 times greater than the sum of the flow cross sections of all of the impingement-cooling holes for the wall element.

4. The combustion chamber assembly according to claim 3, wherein the larger area is 1.8 to 3 times greater than the sum of the flow cross sections of all of the impingement-cooling holes for the wall element.

5. The combustion chamber assembly according to claim 1, and further comprising a web, wherein the flow guide device includes at least one blow-off opening in the web which projects on the rear side of the wall element and which borders the chamber.

6. The combustion chamber assembly according to claim 5, wherein the at least one blow-off opening defines a flow passage which points in a direction of an intermediate space formed between the two cooling-air holes, which are adjacent in a circumferential direction, in the combustion chamber structure.

7. The combustion chamber assembly according to claim 6, wherein the at least one blow-off opening includes a plurality of blow-off openings which each defines a flow passage, and at least two of the flow passages are oriented differently.

8. The combustion chamber assembly according to claim 5, wherein the web extends along at least two edges of the wall element.

9. The combustion chamber assembly according to claim 8, wherein the wall element includes a first wall element and a second wall element and the at least one blow-off opening includes a plurality of blow-off openings, and a radially extending first edge of the first wall element faces a radially extending second edge of the second wall element which is adjacent in a circumferential direction, and, each of the mutually facing first and second edges, includes one of the plurality of blow-off openings oriented in the circumferential direction and such that a respective scavenging-air flow generated by each the plurality of blow-off openings do not intersect.

10. The combustion chamber assembly according to claim 1, wherein the wall element has four sides, each of the four sides having a respective edge, which define an outer contour of the wall element, and the flow guide device includes first and second flow guide devices provided at two gap regions at which two of the four sides converge.

11. The combustion chamber assembly according to claim 1, wherein the wall element includes a plurality of wall elements which are situated adjacent to one another along a circumferential direction and, the flow guide device includes a plurality of flow guide devices, with each of the plurality of wall elements including one of the plurality of flow guide devices.

12. The combustion chamber assembly according to claim 1, wherein the wall element includes first and second wall elements and the first wall element incudes the flow guide device, the flow guide device generating the scavenging-air flow in a direction of the second wall element which is situated adjacent to the first wall element in a circumferential direction.

13. The combustion chamber assembly according to claim 12, wherein the flow guide device generates the scavenging-air flow in a direction of a corner of the second wall element.

14. The combustion chamber assembly according to claim 1, wherein the wall element includes first and second wall elements adjacent to each other in a circumferential direction, the first and second wall elements being separated from one another by a gap, and the scavenging-air flow is directed into the gap.

15. The combustion chamber assembly according to claim 14, wherein the flow guide device includes first and second flow guide devices, with the first and second wall elements respectively including the first and second flow guide devices, with scavenging-air flows of the first and second flow guide device 1) being directed toward interstices between the two cooling-air holes situated in the gap and 2) not intersecting.

16. The combustion chamber assembly according to claim 1, wherein the wall element includes first and second wall elements positioned adjacent one another, wherein the flow guide device includes a first flow guide device and a second flow guide device, wherein the first wall element includes the first flow guide device and the first flow guide device includes a first blow-off opening defining a first flow passage, a second blow-off opening defining a second flow passage and a third blow-off opening defining a third flow passage, wherein the scavenging air flow includes first, second and third scavenging-air flows, wherein the first flow passage extends along a radial direction, the second flow passage extends along a circumferential direction, and the third flow passage extends so as to be inclined with respect to the radial direction and inclined with respect to the circumferential direction, the first, the second, and the third flow passages comprising, respectively, the first, the second, and the third scavenging air flows, wherein the second wall element includes the second flow device producing an adjacent scavenging air flow, wherein at least one chosen from the second and the third scavenging-air flows is arranged so as to not intersect the adjacent scavenging air flow or the cooling-air flow.

17. The combustion chamber assembly according to claim 16, wherein the first, the second, and the third scavenging-air flows intersect neither the adjacent scavenging-air flow nor the cooling-air flow.

18. The combustion chamber assembly according to claim 1, wherein the wall element includes first and second wall elements mounted on the combustion chamber structure, wherein an angle of 150 to 210 degrees is provided between the first and the second wall elements on the outer sides of the first and second wall elements, the cooling-air holes being situated between the first and the second wall elements in a circumferential direction to form the cooling-air flow on one of the first and second wall elements, and the scavenging-air flow is arranged in a direction of an interstice between the two cooling-air holes.

19. The combustion chamber assembly according to claim 1, wherein the wall element includes first and second wall elements, the first wall element being formed as a heat shield with a through hole for a fuel nozzle and being mounted onto a base plate of the combustion chamber structure, and the second wall element being formed as a combustion chamber shingle and mounted onto a combustion chamber wall of the combustion chamber structure, wherein an angle of 70 to 120 degrees is provided between the first and the second wall elements on the outer sides of the first and the second wall elements, the cooling-air holes being situated between the first and the second wall elements in a circumferential direction to form the cooling-air flow on the second wall element, the scavenging-air flow being arranged in a direction of an interstice between the two cooling-air holes.

20. A gas turbine engine having the combustion chamber assembly according to claim 1.

* * * * *